United States Patent [19]

Rizzuto et al.

[11] Patent Number: 4,870,250

[45] Date of Patent: Sep. 26, 1989

[54] REVERSIBLE HAIR CRIMPER

[75] Inventors: Leandro P. Rizzuto, Greenwich, Conn.; Kit-Lun Leung, North Point; Hou-On Lo, Hong Kong, both of Hong Kong

[73] Assignee: Conair Corporation, Stamford, Conn.

[21] Appl. No.: 202,581

[22] Filed: Jun. 6, 1988

[51] Int. Cl.[4] ..... H05B 1/00; A45D 1/04

[52] U.S. Cl. ..... 219/225; 132/229; 219/525

[58] Field of Search ..... 219/222–226, 219/228, 230, 231, 249, 524, 525, 243; 132/223–225, 229, 232, 269, 271; 38/80, 81

[56] References Cited

U.S. PATENT DOCUMENTS 1,465,838 8/1923 Caneavri ..... 219/525
4,034,201 7/1977 Walter et al. ..... 219/222
4,242,567 12/1980 Carter ..... 219/225
4,739,151 4/1988 Smal ..... 219/225

*Primary Examiner*—A. D. Pellinen
*Assistant Examiner*—Geoffrey S. Evans
*Attorney, Agent, or Firm*—Haynes N. Johnson

[57] ABSTRACT

A reversible crimper-straightener for hair including a handle, a pair of pivoted clamp halves secured to the handle, a pair of reversible plates, each plate including a crimping surface on one side thereof and a flattening surface on the opposite side thereof, a heater within at least one of the plates, and tracks and rails on the plates and the clamping halves for securing one of the plates within one of the clamp halves and the other of the plates within the other of the clamp halves. The plates are reversible so that, alternatively, the crimping surfaces or the straightening surfaces face and are proximate to one another.

9 Claims, 3 Drawing Sheets

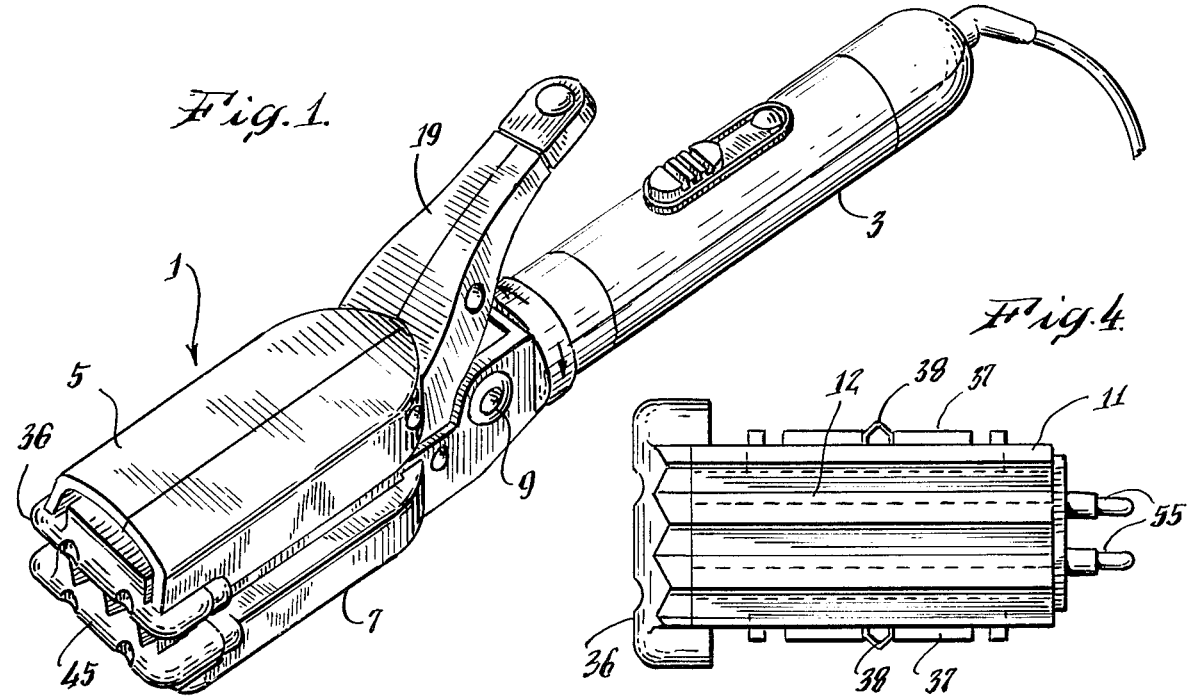
Fig. 1.
19
1
5
36
9
7
45
3
Fig. 4.
12
38
37
11
55
36
38
37
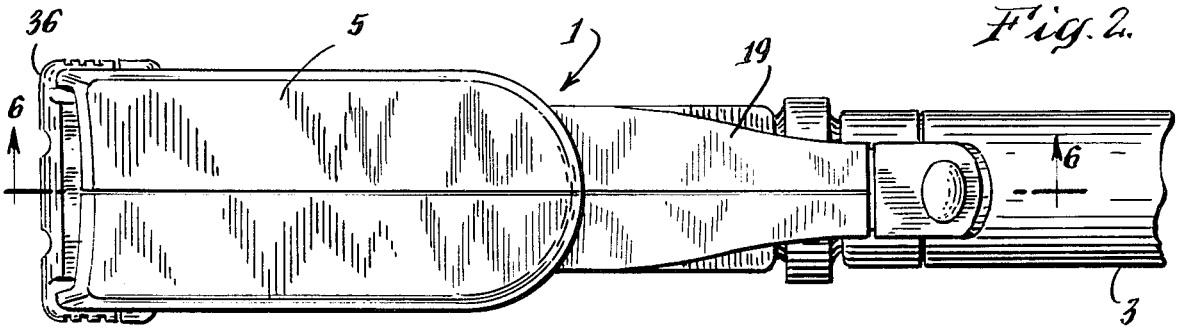
Fig. 2.
36
5
1
19
6
6
3
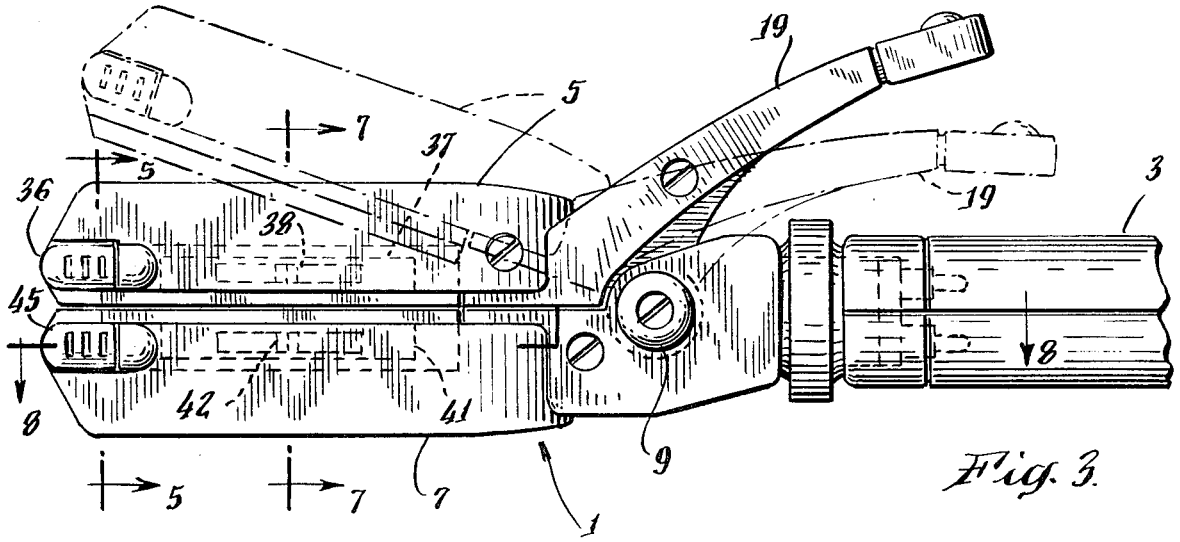
19
5
7
37
5
36
38
19
3
45
8
8
42
41
9
5
7
7
1
Fig. 3.

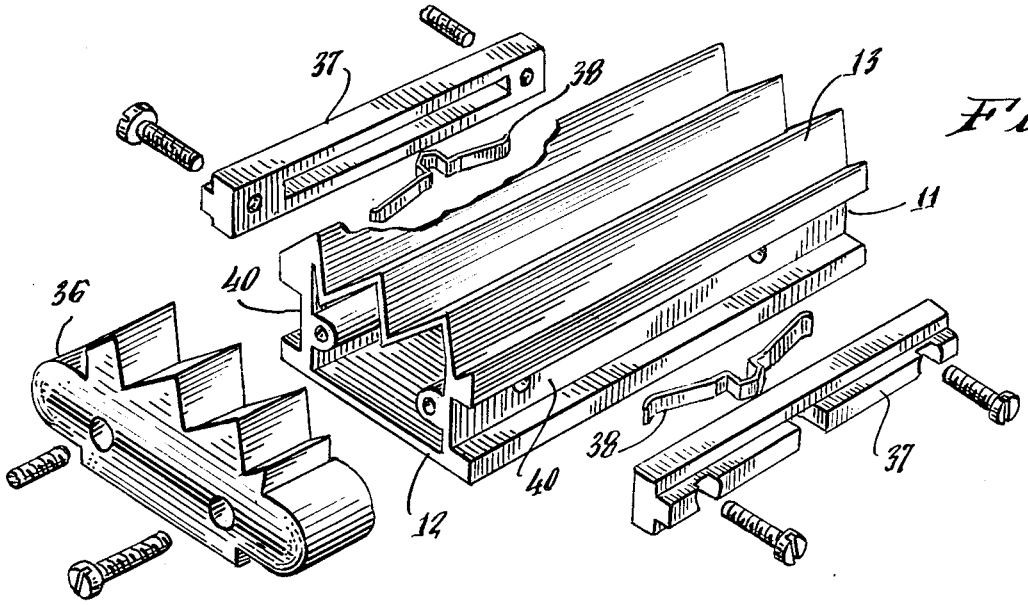
Fig. 9.
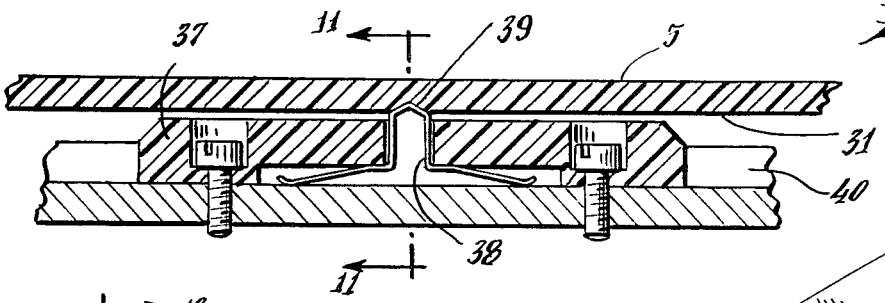
Fig. 10.
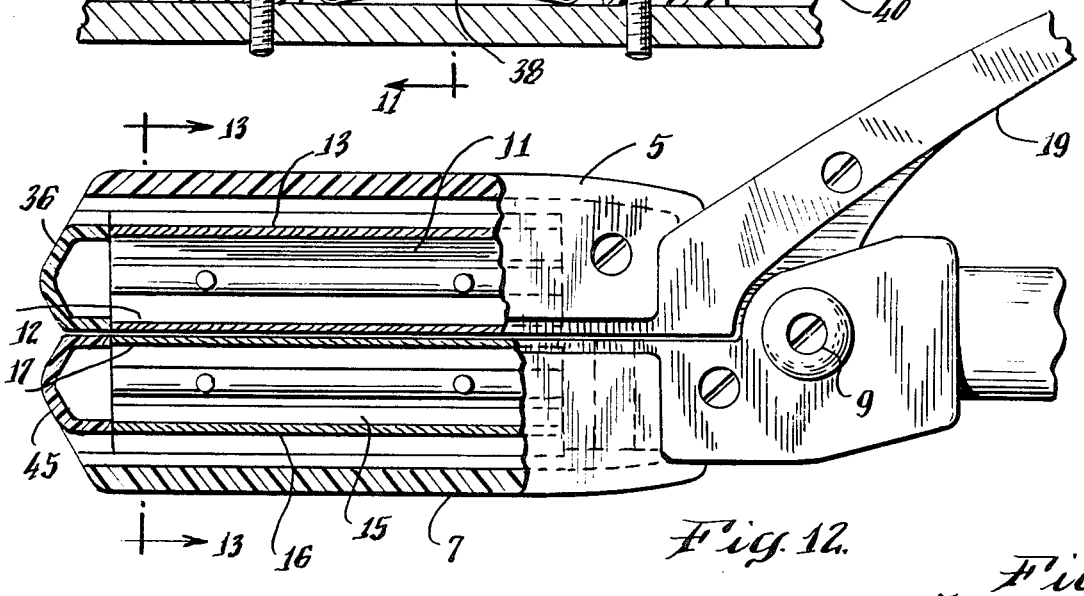
Fig. 12.
Fig. 11.
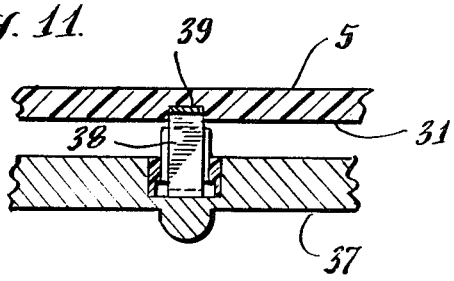
Fig. 13.
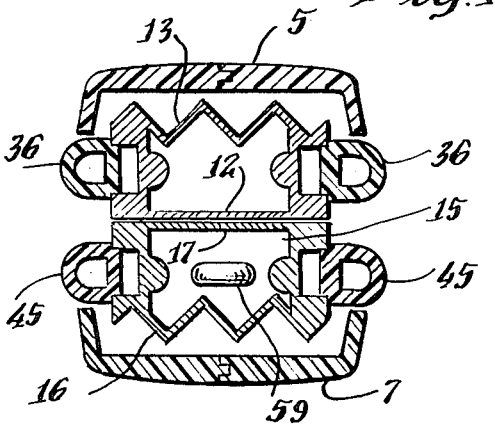

REVERSIBLE HAIR CRIMPER

FIELD OF THE INVENTION

This invention relates to the field of hair curlers and, more particularly, hair crimpers and straighteners which can be used interchangeably, with a common handle, with other types of hair curling devices.

BACKGROUND OF THE INVENTION

Hair crimpers, as such, are old in the art. Examples can be found in Allen U.S. Pat. No. 542,216, Talbot U.S. Pat. No. 1,449,632, Schaumberg U.S. Pat. No. 1,473,977, and Rogler U.S. Pat. No. 1,694,672. These patents, however, do not teach the use of crimpers which are interchangeable with other hair curling devices, using the same handle, nor do they teach units with reversible plates, able to alternatively either crimp or straighten hair.

BRIEF SUMMARY OF THE INVENTION

Our invention is directed to a hair curling or straightening device which is removably attached to a handle having a source of electrical power. The unit includes two heated metal plates held within a spring-pressed clamp. The plates are complementary and reversible, receiving electrical energy in either position. In one position the plates interleave as crimping plates; in the other, they have flat surfaces facing one another, to be used as hair straighteners.

Each plate slides into position in its respective half of the clamp. When in position, one or both of the plates are connected to a source of electricity to operate a heating element within the plate. The clamp halves include tracks, and the plates have corresponding rails which ride in the tracks. The rails are along the sides of the plates and so positioned that the plates can be reversed and still use the tracks and be connected to the source of power. The rails include detents, spring-pressed outwardly, which serve to hold the plates in place.

DESCRIPTION OF THE DRAWINGS

FIG. 1 is a perspective view of the crimper-straightener positioned in the power handle.

FIG. 2 is a plan view of the unit.

FIG. 3 is a side elevational view of the unit when closed, showing the open position in dashed lines.

FIG. 4 is a top plan view of the lower plate, showing the electrical connections.

FIG. 9 is an exploded perspective of the upper plate, showing its construction. The lower plate is similar in these respects.

FIG. 10 is a horizontal section showing the detent locking means for the upper plate. The lower plate is similar.

FIG. 11 is a vertical section, taken on line 11—11 of FIG. 10, showing further details of the detent.

FIG. 12 is a side elevation, partly broken away, showing the two plates mounted in the clamp halves for use as hair straighteners.

FIG. 13 is a vertical transverse section, taken on line 13—13 of FIG. 12, showing the plates mounted as straighteners.

DETAILED DESCRIPTION OF THE INVENTION

Figure 6:
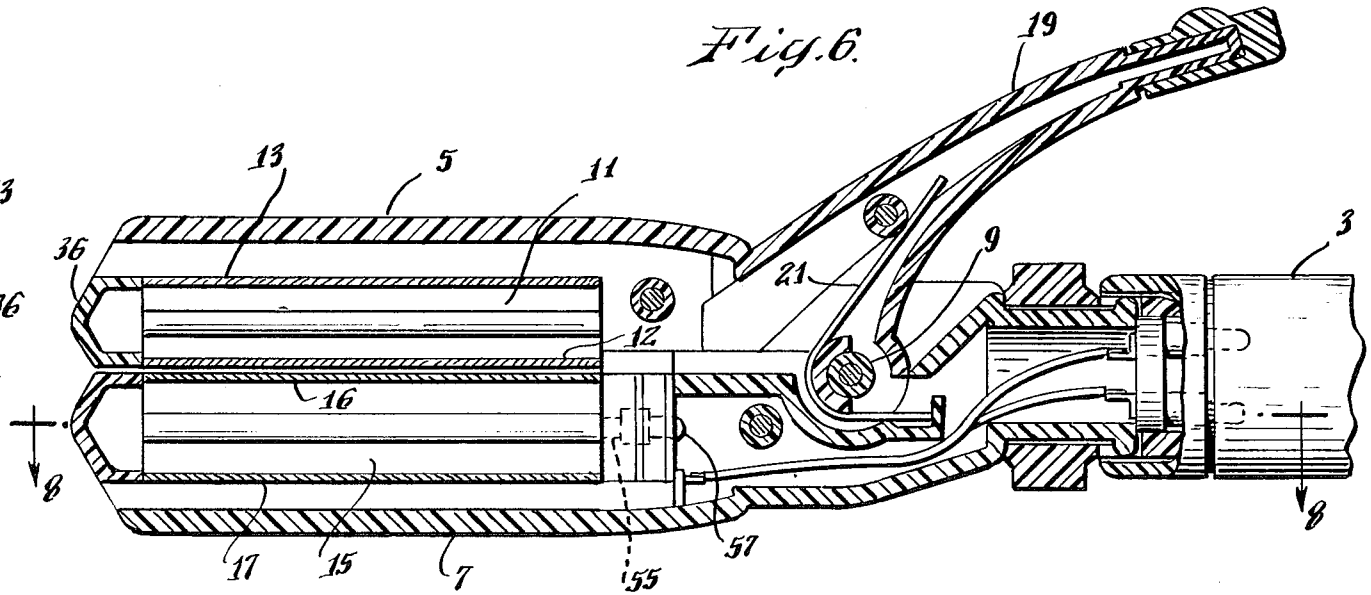
FIG. 6 is vertical longitudinal section, taken on line 6—6 of FIG. 2.

Our crimper-straightener 1 is designed to removably fit with a handle 3 supplying electrical power. The crimper 1 and handle 3 fit together by any of various well-known means.

Crimper 1 is made up of an upper clamp half 5 and a lower clamp half 7 pivotally held together at pivot point 9. The halves are made of molded plastic. Each half contains an aluminum plate. Upper clamp half 5 carries upper plate 11 which has a crimping surface 12 with a saw-tooth surface on one side and a flat straightening surface 13 on its other side. Lower clamp half 7 carries lower plate 15 with crimping surface 16 on one side and flat surface 17 on its other side.

Figure 5:
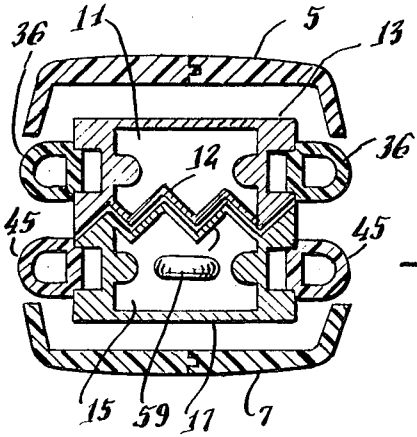
FIG. 5 is a vertical transverse section, taken on line 5—5 of FIG. 3, showing the two plates mounted for crimping.
Figure 7:
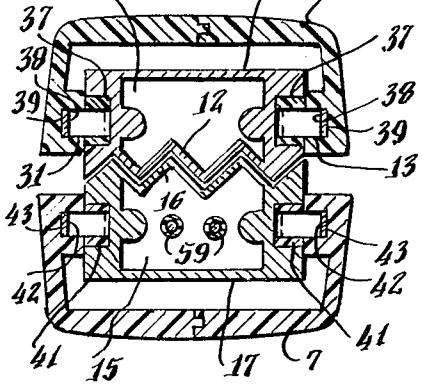
FIG. 7 is a vertical transverse section, taken on line 7—7 of FIG. 3, showing the method of mounting the plates within the clamp halves.

The plates 11 and 15 are reversible within their respective clamp halves 5 and 7. Thus, the plates may be carried with their crimping surfaces 12 and 16 facing one another (FIGS. 5 and 7), for use in crimping hair, or with their flat surfaces 13 and 17 facing one another (FIG. 13), for straightening hair. The shape of the two crimping surfaces is such that, when facing one another, they complementarily interfit (FIGS. 5 and 7).

Upper clamp half 5 carries a clamp release arm 19 of the usual type. It is spring-pressed to a closed position by spring 21 (FIG. 6). Pressure on arm 19 serves to open the clamp halves 5 and 7, about pivot 9, so that hair may be placed between, or removed from, plates 11 and 15.

A feature of our invention is the means by which upper plate 11 is reversibly held in upper clamp half 5 and lower plate 15 is reversibly held in lower clamp half 7. Each plate has a pair of side rails, one on each side of the plate. Thus, upper plate 11 has rails 37, and lower plate 15 has rails 41 (See FIGS. 4, 7, and 9). The rails extend from each side of the plate and run parallel to the longitudinal axis of the plate. Rails 37 fit within slots 40 on plate 11 and can be screwed into place (FIG. 9). Each rail 37 includes a spring-pressed detent 38 near its center, to be received in a hole 39 on track 31 to hold the rails in place in the track. Thus, plate 11 can be removed from upper clamp half 5 by sliding it longitudinally outwardly. It can then be reversed, so that flat surface 13 is exposed for use instead of crimping surface 12, or vice-versa.

Lower plate 15 is similar, having rails 41 and spring-pressed detents 42 which press into holes 43 on track 33. It has the same reversing feature as upper plate 11.

It should be noted that the rails are so positioned relative to their respective tracks that the plate surfaces of the two plates will be in contact when the clamp halves are closed, regardless of whether the crimping surfaces or the flat surfaces are used.

If desired, surface configurations other than crimping and flat may be used. These configurations should, however, complementarily interfit with one another when installed.

Figure 8:
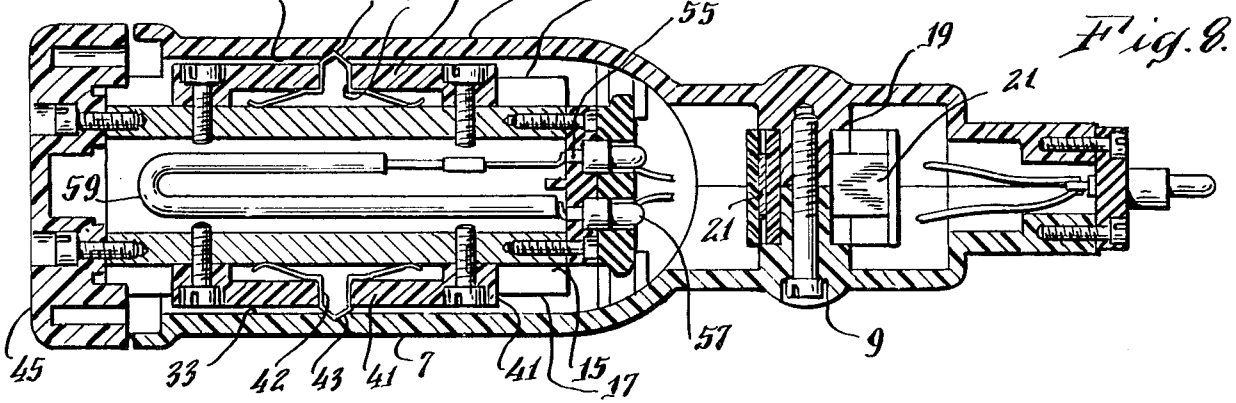
FIG. 8 is a horizontal section, taken on line 8—8 of FIG. 3, showing the internal wiring and the track, rail, and detent structure.

At least one of the plates includes a heating element 59. FIG. 8 shows it to be in lower plate 7, and it is connected through electrical connectors 55 to connectors 57 on the lower clamp half. The latter are, in turn, connected to a source of electricity in handle 3 (not shown). Connectors 55 are so positioned relative to connectors 57 that they will engage regardless of which surface of plate 15 is being used. When only one plate includes a heating element, the other plate is heated from it by conduction.

The exploded view of FIG. 9 also shows a finishing end piece 36 screwed to the end of upper plate 11. It is usually molded plastic and has a configuration conforming to the surfaces 12 and 13 of the upper plate. Lower plate 15 has a similar end piece 45 (FIG. 12).

To use our crimper-straightener unit, the plates are slid into their respective clamp halves. This can be done with the crimping surfaces 12 and 16 facing one another, as in FIGS. 5 and 7, or with the flat surfaces 13 and 17 facing one another, as in FIG. 13. Installation of lower plate 15 will serve to connect the electrical contacts. The unit is plugged in and turned on and allowed to heat. After heating, finger pressure on clamp release 19 will spread the clamp halves allowing hair to be inserted, and the clamp halves closed. After adequate time has passed, the halves are again opened and the hair removed.

We claim:

1. In a hair curling unit, said unit including a handle and pivoted upper and lower clamp halves thereon and electrical connections therein, that improvement including a pair of reversible heatable metal plates, each of said plates having a first surface on one side thereof and a second surface on the other side thereof, said first surfaces being complementary to one another and said second surfaces being complementary to one another, means for reversibly securing one of said plate to one of said clamp halves and the other of said plates to the other of said clamp halves, with either said first surfaces or said second surfaces facing each other, and heating means associated with at least one of said plates, whereby said hair curling unit may be configured for use with either of said first or said second surfaces.

2. In a hair curling unit as set forth in claim 1 that improvement in which said first surfaces are configured for crimping and said second surfaces are flat.

3. In a hair curling unit, said unit including a handle and pivoted upper and lower clamp halves thereon and electrical connections therein, that improvement including a pair of heatable metal plates, each of said plates having a first surface on one side thereof and a second surface on the other side thereof, said first surfaces being complementary to one another and said second surfaces being complementary to one another, means for securing one of said plates to one of said clamp halves and the other of said plates to the other of said clamp halves, with either said first surfaces or said second surfaces facing each other, said securing means including complementary longitudinal tracks and rails on the said clamp halves and said plates, and heating means associated with at least one of said plates, whereby said plates may be slidingly inserted into, or removed from, said clamp halves so that said hair curling unit may be configured for use with either said first or said second surfaces.

4. In a hair curling unit as set forth in claim 3, that improvement including detent means in said rails for engaging with said plates.

5. A reversible crimper-straightener for hair including a handle, a pair of pivoted clamp halves secured to said handle, a pair of reversible plates, each said plate including a crimping surface on one side thereof and a flattening surface on the opposite side thereof, means for securing one of said plates within one of said clamp halves and the other of said plates within the other of said clamp halves, said securing means being reversible so that, alternatively, said crimping surfaces of said straightening surfaces face and are proximate to one another, whereby said crimper may alternatively be used for either crimping or straightening of hair.

6. A reversible crimper-straightener for hair including a handle, a pair of pivoted clamp halves secured to said handle, a pair of reversible plates, each said plate including a crimping surface on one side thereof and a flattening surface on the opposite side thereof, means for securing one of said plates within one of said clamp halves and the other of said plates within the other of said clamp halves, said securing means being reversible so that, alternatively, said crimping surfaces or said straightening surfaces face and are proximate to one another, and said securing means including a longitudinally extending rail on each side of each of said plates and a corresponding receiving track on each side of each of said clamp halves, and locking means for holding said rails within their respective said tracks, whereby said plates may be slidingly removed from their respective said clamp halves, reversed, and reinserted into said clamp halves, so that said crimper may alternatively be used for either crimping or straightening of hair.

7. A crimper-straightener as set forth in claim 6 in which said locking means are spring-pressed detents.

8. A reversible plate for use in clamping halves in a hair curling device, said clamping halves having slidingly engageable surfaces thereon for receiving said plate, said plate including first and second surfaces on opposite upper and lower portions of said plate, one of said surfaces being configured for crimping hair and the other of said surfaces being configured for different hair treatment, longitudinal slidingly engageable surfaces on left and right sides of said plates, said latter surfaces being configured to interfit with said slidingly engageable surfaces on said clamping halves, whereby said plates may be reversed in said clamping halves.

9. A reversible plate as set forth in claim 8 in which the other of said surfaces is a flat surface for straightening hair.

* * * * *